US008649709B2

(12) United States Patent
Ichikawa

(10) Patent No.: US 8,649,709 B2
(45) Date of Patent: Feb. 11, 2014

(54) TONER SUPPLYING DEVICE AND IMAGE FORMING APPARATUS

(75) Inventor: Yoshiki Ichikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 707 days.

(21) Appl. No.: 12/894,272

(22) Filed: Sep. 30, 2010

(65) Prior Publication Data

US 2011/0081169 A1 Apr. 7, 2011

(30) Foreign Application Priority Data

Oct. 5, 2009 (JP) ..... 2009-231734

(51) Int. Cl.
*G03G 15/08* (2006.01)

(52) U.S. Cl.
USPC ..... 399/258

(58) Field of Classification Search
USPC ..... 399/254, 256, 258, 259, 263
See application file for complete search history.

(56) References Cited

U.S. PATENT DOCUMENTS

2010/0092196 A1* 4/2010 Mimura ..... 399/55

FOREIGN PATENT DOCUMENTS

| | | |
|---|---|---|
| JP | 04-053982 | 2/1992 |
| JP | 08-129113 | 5/1996 |
| JP | 2001-318517 | 11/2001 |
| JP | 2008-281868 | 11/2008 |

* cited by examiner

*Primary Examiner* — Walter L Lindsey, Jr.
*Assistant Examiner* — Ruth Labombard
(74) *Attorney, Agent, or Firm* — Renner, Otto, Boisselle & Sklar, LLP

(57) ABSTRACT

A toner supplying device and an image forming apparatus that supply toner stably and do not impose a stress on toner, regardless of a remaining amount of toner stored in a storage container of the toner supplying device are provided. Two flexible sheets constituting a toner scooping blade are bonded to each other with a double-sided adhesive tape that functions as a spacer and an adhesive member sandwiched therebetween at an end fixed to a blade support neck and the other end in contact with an inner wall of the toner storage container. Whereby, a gap is formed between the two flexible sheets.

4 Claims, 8 Drawing Sheets

TONER SUPPLYING DEVICE AND IMAGE FORMING APPARATUS

CROSS-NOTING PARAGRAPH

This non-provisional application claims priority under 35 U.S.C. §119(a) on Patent Application No. 2009-231734 filed in JAPAN on Oct. 5, 2009, the entire contents of which are hereby incorporated herein by reference.

FIELD OF THE INVENTION

The present invention relates to a toner supplying device of an image forming apparatus forming an image with a two-component developer containing toner and a magnetic carrier.

BACKGROUND OF THE INVENTION

Conventionally, there have been used many image forming apparatuses employing the electrophotographic method as an image forming apparatus such as a copier or a printer.

The image forming apparatus employing the electrophotographic method forms an electrostatic latent image on the surface of a photoreceptor (toner image carrier). The image forming apparatus then develops the electrostatic latent image with toner supplied from a developing device, and transfers and fixes a toner image thus developed to a recording medium such as a sheet.

In recent years, a two-component developer excellent in toner charging stability has been used as a developer for the purpose of obtaining color images and high quality images. The two-component developer is composed of toner and a carrier, which are stirred in a developing device so that the toner and the carrier are rubbed against each other, and properly charged toner is obtained by the friction.

In such a two-component developer, since toner is consumed in every developing processing, a developing device is provided with a toner cartridge (which is also referred to as a toner supplying device) supplying (replenishing) toner into the developing device depending on a toner consumption amount.

As a toner cartridge, for example, a toner cartridge disclosed in Japanese Laid-Open Patent Publication No. 2008-281868 is known that is provided with a toner storage container that stores toner, a toner discharge roller that discharges toner, and a toner scooping member (stirring vane) that scoops up toner toward the toner discharge roller.

However, there is a casein the toner cartridge disclosed in Japanese Laid-Open Patent Publication No. 2008-281868 that when a toner amount remaining in the toner cartridge is large, if a sheet of the toner scooping member is thickened for increasing stiffness in order to scoop up the toner reliably, a toner stirring torque becomes so large that an unnecessary pressure (stress) is imposed on the toner to deteriorate the toner, resulting that fluidity of the toner is lowered. There is also a case that when a toner amount remaining in the toner cartridge decreases, the toner amount remaining scooped up by the toner scooping member becomes small so that a toner supply amount is reduced.

SUMMARY OF THE INVENTION

An object of the present invention is to provide a toner supplying device and an image forming apparatus that supply toner stably and do not impose an unnecessary stress on toner, regardless of a remaining amount of toner stored in a storage container of the toner supplying device.

Another object of the present invention is to provide a toner supplying device having a blade support member that supports and rotates a toner scooping blade provided in a toner storage container that has a cross section formed roughly in a semicircular shape, and causing the toner scooping blade to rotate so that toner is scooped up and supplied to a developing device, in which the toner scooping blade is composed of two flexible sheets, the two flexible sheets are bonded to each other with a spacer sandwiched therebetween at an end fixed to the blade support member and the other end in contact with an inner wall of the toner storage container, and a gap is formed between the two flexible sheets.

Another object of the present invention is to provide the toner supplying device in which the flexible sheet is a PET film of 0.1 mm or more to 0.5 mm or less in thickness.

Another object of the present invention is to provide the toner supplying device in which the spacer is a double-sided adhesive tape of 0.05 mm or more to 1 mm or less in thickness.

Another object of the present invention is to provide the image forming apparatus provided with the toner supplying device.

PREFERRED EMBODIMENTS OF THE INVENTION (Outline of Image Forming Apparatus)

First, an outline of an image forming apparatus will be described with reference to FIG. 1.

Figure 1:
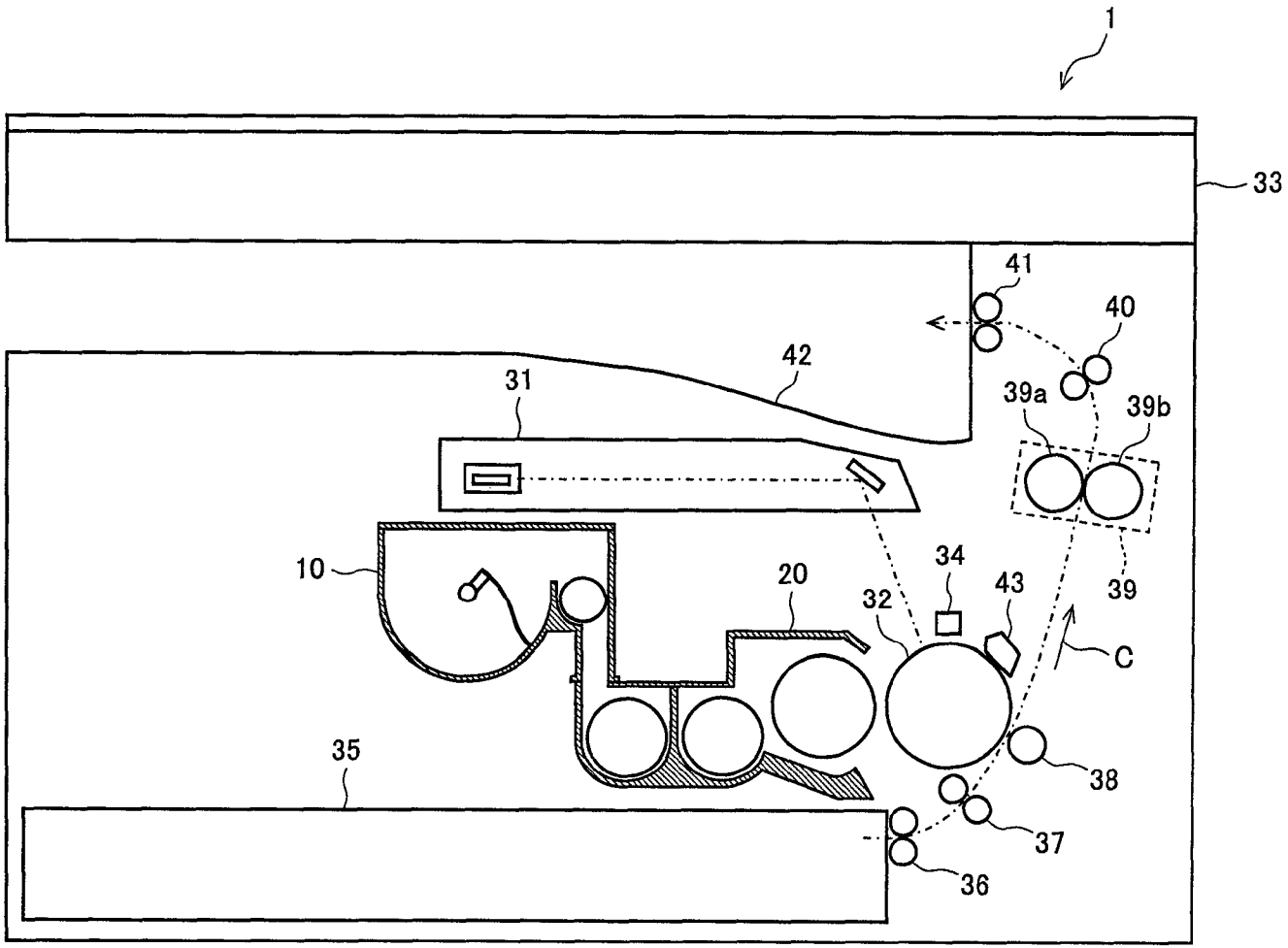
FIG. 1 is a view schematically showing a configuration of an image forming apparatus according to one embodiment of the present invention.

FIG. 1 is a view schematically showing a configuration of an image forming apparatus 1 according to one embodiment of the present invention. The image forming apparatus 1 forms a monochrome or a single color image on a recording medium in accordance with input image information.

A toner supplying device (which is also referred to as a toner cartridge) 10 disposed in the center part of the image forming apparatus 1 stores toner therein and supplies toner into a developing device 20. Note that, the toner supplying device 10 is detachably mounted in the image forming apparatus 1.

The developing device 20 supplies toner to an electrostatic latent image on the surface of a photosensitive drum 32 formed by an exposure device 31, to form a toner image. Note that, the toner supplying device 10 and the developing device 20 will be described in detail below.

The exposure device 31 applies signal light that corresponds to image information of a document scanned by a scanner unit 33 or image information input from an external equipment to the surface of the photosensitive drum 32 that has been uniformly charged by a charging device 34 to form an electrostatic latent image corresponding to the image information on the surface. The exposure device 31 is provided such that the signal light emitted therefrom passes through between the charging device 34 and the developing device 20 and that irradiates the surface of the photosensitive drum 32 with the signal light.

The photosensitive drum 32 is a roller-shaped member axially supported to be rotationally drivable about an axis by a driving portion (not shown), and includes, for example, a conductive base (not shown) and a photosensitive layer (not shown) formed on the surface of the conductive base. On the surface of the photosensitive layer, an electrostatic latent image and then a toner image are formed.

The scanner unit 33 reads a document set by an ADF or a user on a document placing surface of a document platen that is composed of a plate member formed of glass, and converts the read document image information photoelectrically one after another to output as electric signals to a control portion of the image forming apparatus 1. The control portion converts image information input from the scanner unit 33 or image information included in printing job data input from an external equipment to a control signal corresponding to the image information, and outputs it to the exposure device 31. The exposure device 31 directs signal light that corresponds to input image information to the surface of the photosensitive drum 32, to form an electrostatic latent image corresponding to the image information on the surface. In addition, toner is supplied from the developing device 20 to the photosensitive drum 32 to develop the electrostatic latent image formed on the photosensitive drum 32.

The charging device 34 is connected to a power source (not shown), and receives a voltage applied from the power source to charge the surface of the photosensitive drum 32 to a prescribed polarity and potential.

In forming an electrostatic latent image on the surface of the photosensitive drum 32 and developing the electrostatic latent image, a recording medium is transported from a paper feed cassette 35 that is provided vertically below the image forming apparatus 1 to a transfer device 38 of the photosensitive drum 32 through a pick-up roller 36 and a first transport roller 37. Examples of the recording medium include plain paper, coated paper, color copy paper and a sheet for overhead projector (OHP).

The transfer device 38 is a roller-shaped member that is axially supported by a support member (not shown) in a rotatable manner and provided to be rotationally drivable around an axis by a driving portion (not shown), and is provided to be in pressure-contact with the photosensitive drum 32. The transfer device 38 is connected to a power source (not shown), receives a voltage (hereinafter referred to as "transfer bias") of a polarity opposite to the toner charging polarity forming a toner image held on the surface of the photosensitive drum 32, applied from the power source, and transfers the toner image held on the surface of the photosensitive drum 32 to the recording medium transported from the paper feed cassette 35 smoothly.

When the recording medium passes through a pressure-contact portion (transfer nip portion) of the photosensitive drum 32 and the transfer device 38, the transfer device 38 applies the transfer bias and thereby transfers the toner image carried on the surface of the photosensitive drum 32 to the recording medium. The recording medium on which the toner image has been transferred, is transported to a fixing device 39.

The fixing device 39 is provided on the downstream side in a recording medium transporting direction C, and includes a fixing roller 39*a* and a pressurizing roller 39*b*. When the recording medium on which the toner image has been transferred in the transfer device 38 passes through a pressure-contact portion between the fixing roller 39*a* and the pressurizing roller 39*b*, the fixing roller 39*a* heats and melts toner forming the toner image and the pressurizing roller 39*b* presses the toner to the recording medium in order to fix the toner image on the recording medium.

The recording medium on which the toner image has been fixed is discharged to a discharge tray 42 through a second transport roller 40 and a discharge roller 41.

A cleaning device 43 removes toner, paper dust and the like left on the surface of the photosensitive drum 32 after the toner image is transferred to the recording medium in order to clean the surface of the photosensitive drum 32.

The toner supplying device 10 and the developing device 20 will be described in detail below.

(Toner Supplying Device)

First, description will be given for the toner supplying device 10 that is the feature of the present invention with reference to FIGS. 2 to 5.

Figure 2:
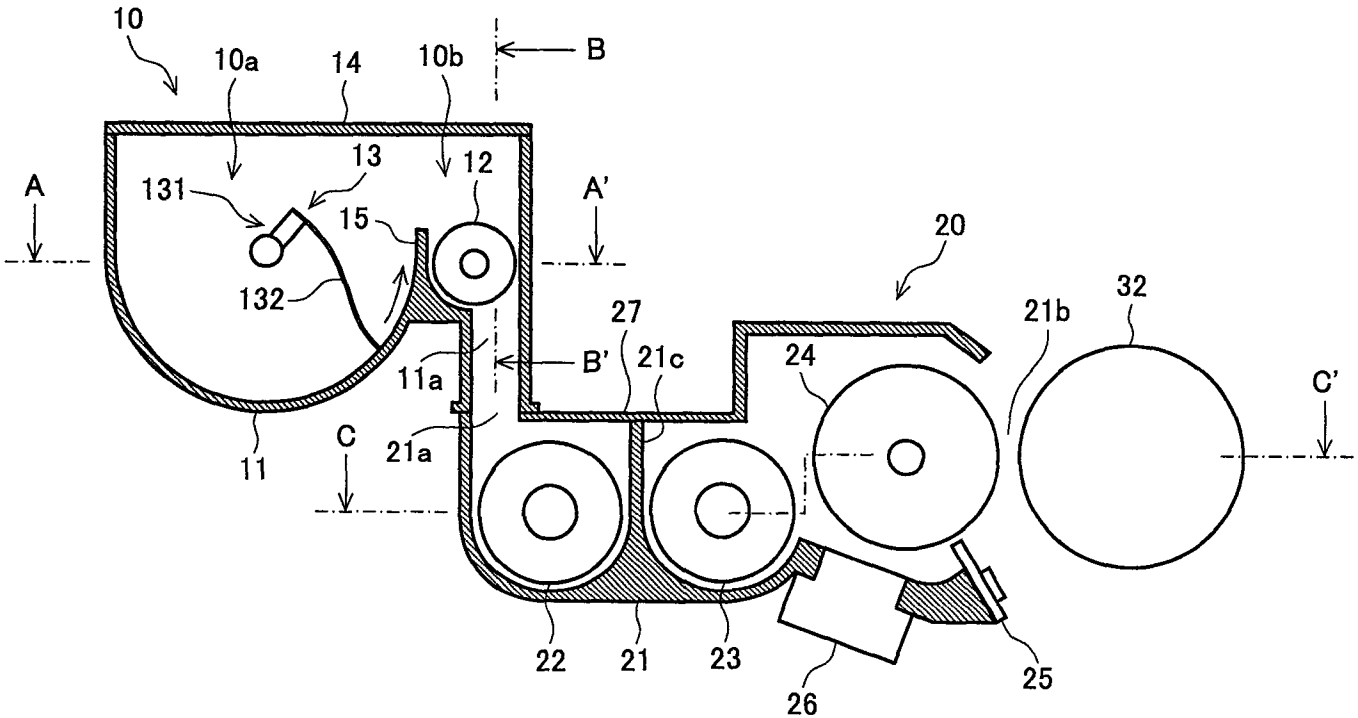
FIG. 2 is an enlarged sectional view of the perimeter of a toner supplying device and a developing device.
Figure 3:
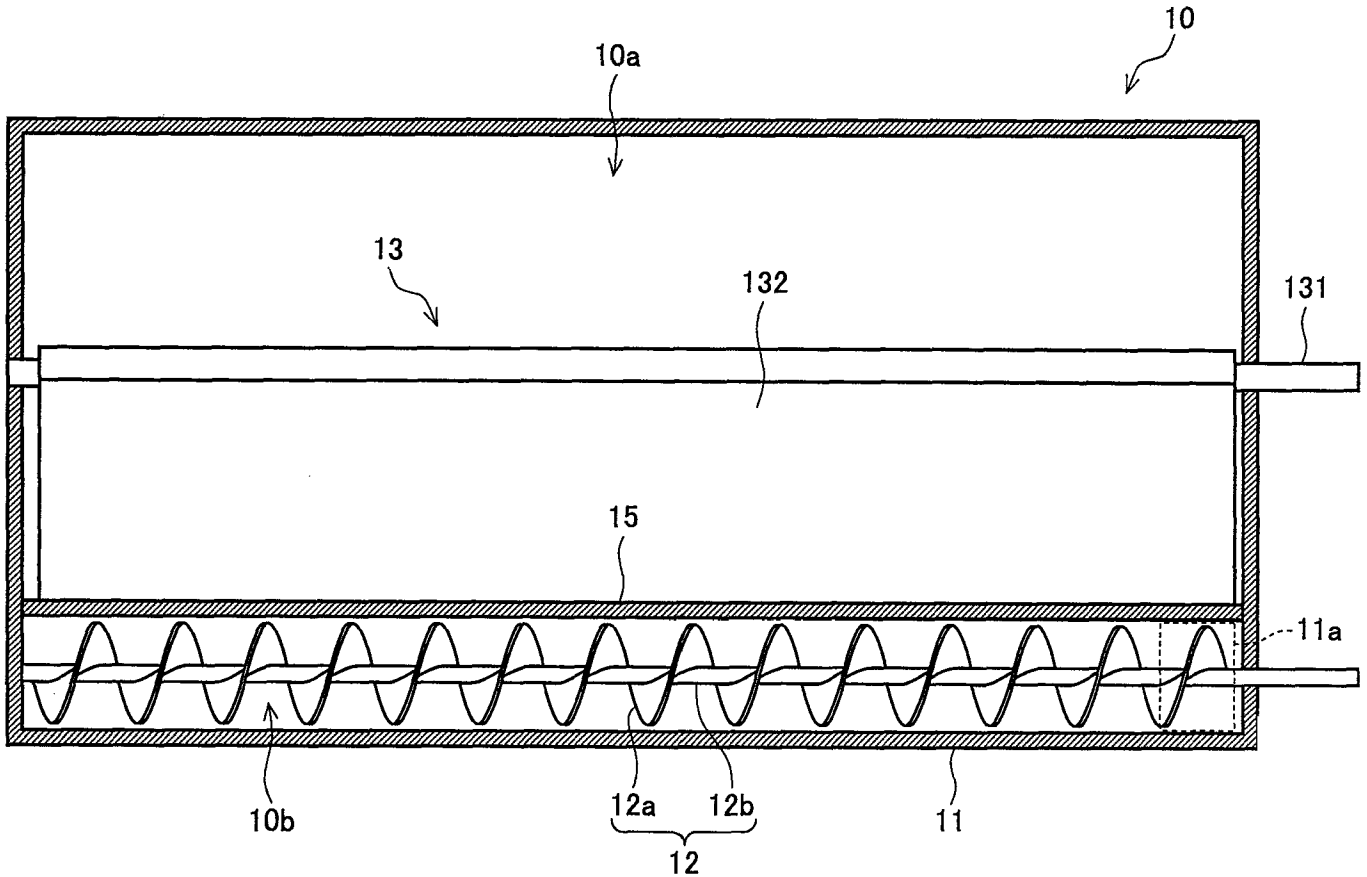
FIG. 3 is a view along an A-A' line of the developing device shown in FIG. 2.
Figure 4:
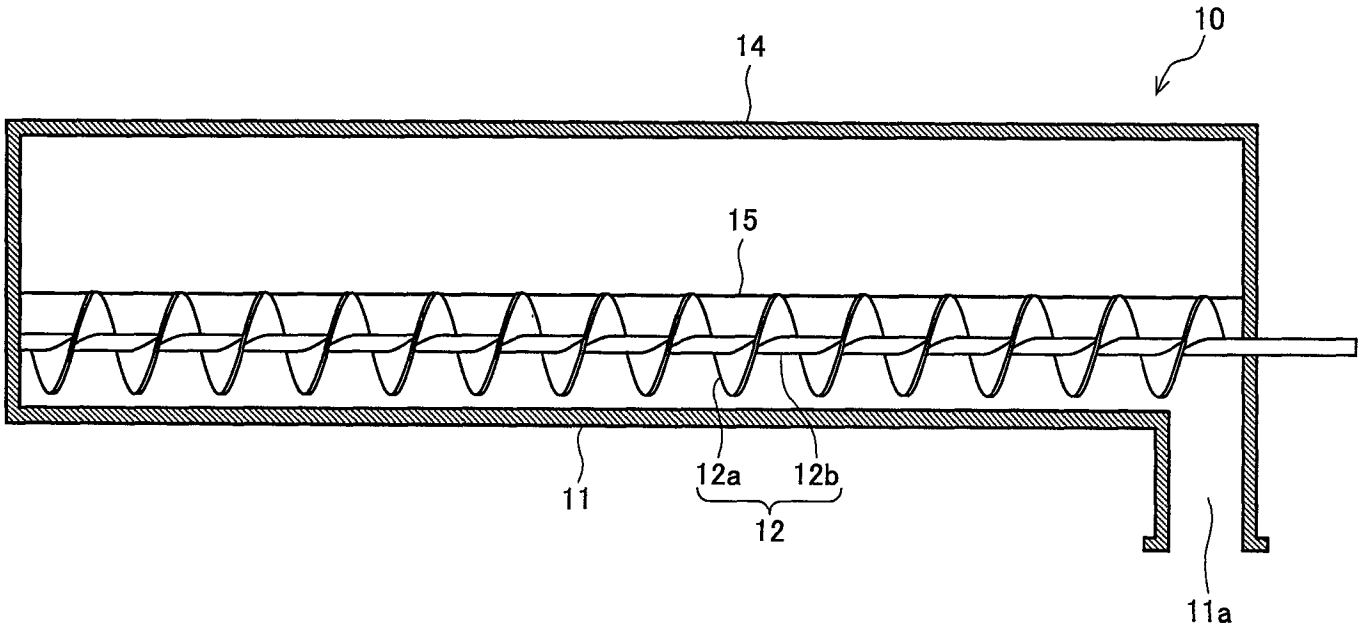
FIG. 4 is a view along a B-B' line of the developing device shown in FIG. 2.
Figure 5:
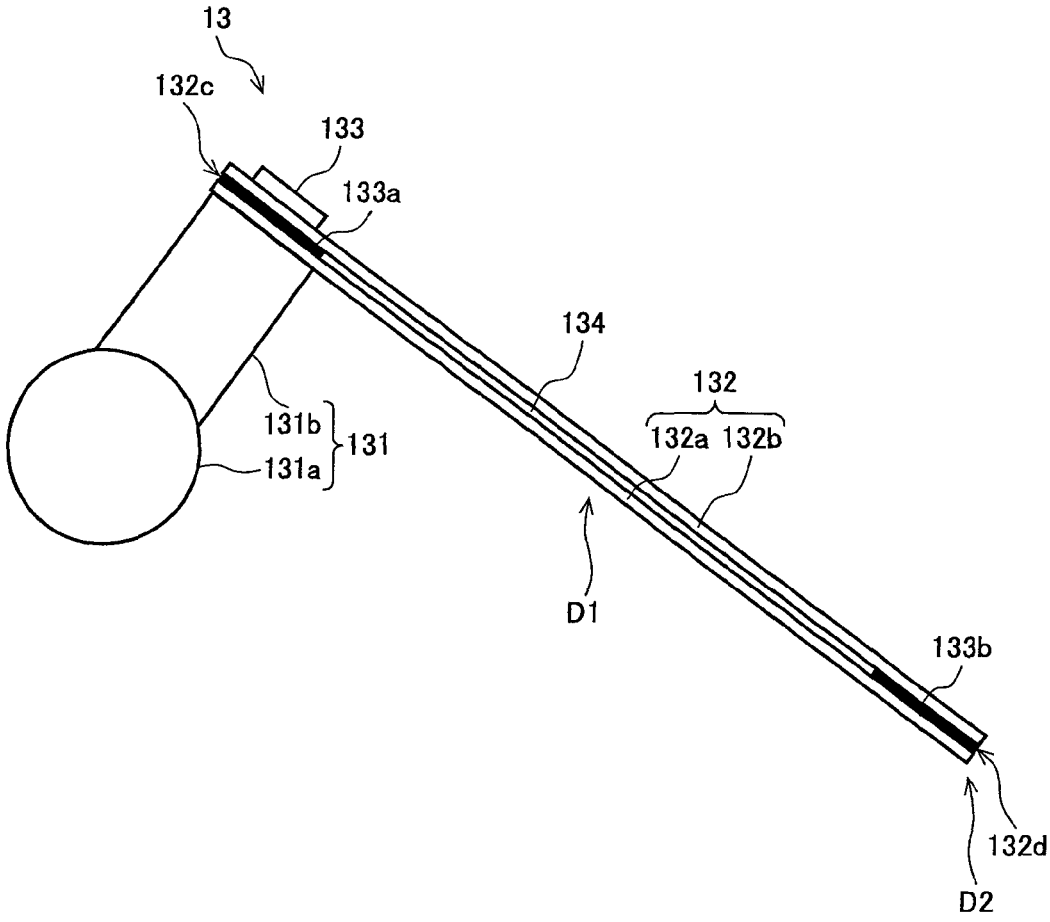
FIG. 5 is an enlarged view of a toner scooping member shown in FIG. 2.

FIG. 2 is an enlarged sectional view of the perimeter of the toner supplying device 10 and the developing device 20, FIG. 3 is a view along an A-A' line of the toner supplying device 10 shown in FIG. 2, FIG. 4 is a view along a B-B' line of the toner supplying device 10 shown in FIG. 2 and FIG. 5 is an enlarged view of a toner scooping member 13 shown in FIG. 2.

The toner supplying device 10 has a toner storage container 11, a toner discharge member 12 and the toner scooping member 13.

The toner storage container 11 is a container-shaped member with a bottom which has an upper opening and an inner space for storing toner and the cross section of which is formed to have a substantially semicircular shape, and the upper opening is sealed by an upper lid 14.

As shown in FIG. 3, at one end of the bottom part of the toner storage container 11 in the longitudinal direction, a toner discharge port 11*a* is formed, which is an opening having a substantially rectangular shape.

The toner discharge port 11*a* is formed at a position communicable to a toner receiving port 21*a* (refer to FIG. 2) provided at an upper part of a developing vessel 21 of the developing device 20, when the toner supplying device 10 is mounted on the developing device 20, and toner is supplied from the toner supplying device 10 into the developing vessel 21 through the toner discharge port 11*a* in accordance with the state of toner consumption in the developing vessel 21.

At the bottom part of the toner storage container 11, a partition wall 15 is provided to divide the inner space of the toner storage container 11 into a toner stirring portion 10*a* and a toner discharge portion 10*b*.

The partition wall 15 is a plate-shaped member extending along the longitudinal direction of the toner storage container 11, and is formed to keep a space under the upper lid 14. That is, the toner stirring portion 10*a* and the toner discharge portion 10*b* are communicated between the upper lid 14 and the partition wall 15.

Inside the toner discharge portion 10*b* and above the toner discharge port 11*a*, the toner discharge member 12 is disposed.

As shown in FIGS. 3 and 4, the toner discharge member 12 is provided with a spiral vane 12*a* and a first rotary shaft 12*b*.

The toner discharge member 12 is driven by a motor and gear (not-shown) and rotates around the first rotary shaft 12*b* to transport the toner in the toner discharge portion 10*b* of the toner storage container 11 to the toner discharge port 11*a* from both ends in the axial direction of the toner discharge member 12 and supply the toner to the developing vessel 21 of the developing device 20 through the toner discharge port 11*a*.

As shown in FIG. 2, the toner scooping member 13 that is the feature of the present invention is stored in the toner stirring portion 10*a*.

The toner scooping member 13 is provided with a blade support member 131 and a toner scooping blade 132, and is driven by a motor and gear (not-shown). Note that, the motor is connected to the control portion of the image forming apparatus 1, and the control portion controls the rotating operation of the blade support member 131.

As shown in FIG. 5, the blade support member 131 is provided with a blade support rotary shaft 131*a* and a blade support neck 131*b*. The blade support rotary shaft 131*a* is a columnar-shaped member with the axis extending along the longitudinal direction of the toner storage container 11 and both ends of which are axially supported by the toner storage container 11 in a rotatable manner respectively. The blade support neck 131*b* is a rectangular-columnar-shaped member extending along the longitudinal direction of the toner storage container 11 and one end of which is fixed to the blade support rotary shaft 131*a* to rotate with the blade support rotary shaft 131*a*.

The toner scooping blade 132 is composed of two flexible sheets (whose thickness is, for example, 0.35 mm) which are formed to have lengths in the longitudinal direction that are substantially equal to the length in the longitudinal direction of the blade support neck 131*b*, and one end of which is fixed to the blade support neck 131*b* with a screw 133 and the other end is provided to be able to touch an inner wall of the toner storage container 11.

The two flexible sheets (132*a* and 132*b*) constituting the toner scooping blade 132 are adhered to each other at an end 132*c* on the side of the blade support neck 131*b* and an end 132*d* on the inner wall side of the toner storage container 11 with double-sided adhesive tapes (133*a* and 133*b*) respectively.

That is, the two flexible sheets (132*a* and 132*b*) are bonded to each other at the end 132*c* that is fixed to the blade support neck 131*b* and the other end 132*d* that is in contact with the inner wall of the toner storage container 11 with the double-sided adhesive tapes (133*a* and 133*b*) functioning as a spacer and an adhesive member sandwiched between them. This causes a gap 134 to be formed between the two flexible sheets (132*a* and 132*b*). Note that, when a member with low stiffness such as paper or a ultrathin styrofoam sheet is inserted into the gap 134, it is possible to prevent toner from entering the gap 134.

In this manner, since opposite ends of the two flexible sheets are fixed, the adequate gap (space) is formed between the flexible sheets. This gap provides a two-layer structure in which a middle portion D1 (refer to FIG. 5) of the two flexible sheets is slidable and a displacement stress can be absorbed. As a result, compared to the case where one flexible sheet having the same thickness as the two flexible sheets is used, the toner scooping blade is bent easily to increase a deformation amount.

With this gap, when the toner scooping blade deforms, a tip end portion D2 (refer to FIG. 5) thereof is given a force to bend in the direction opposite to the middle portion D1. That is, the tip end portion D2 is given a force to deform into an S-shape and therefore becomes tough.

As a result, when the amount of toner remained in the toner storage container 11 is large, the deformation amount of the toner scooping blade increases, and therefore, it is possible to suppress the stress on toner by reducing a driving torque. In addition, when the amount of toner remained in the toner storage container decreases, the tip end portion D2 of the toner scooping blade becomes tough, and therefore, it is possible to scoop up toner reliably.

The material forming the flexible sheets (132*a* and 132*b*) is not particularly limited, but polyethylene terephthalate (PET) is preferable and the thickness thereof is preferably from 0.1 mm to 0.5 mm. Whereby, the flexible sheets have low frictional resistance as well as excellent stiffness and elasticity, therefore, the resistance is weakened in sliding and the toner scooping blade deforms smoothly.

As means for bonding (fixing) the two flexible sheets, any means capable of fixing the flexible sheets such as adhesive agent, heating and fusing, or rivet may be used without particular limitation, but it is preferable to fix the sheets with use of a double-sided adhesive tape whose thickness is from 0.05 mm to 1 mm, because that tape also functions as a spacer and the gap between the two flexible sheets is kept constant.

Figure 6A:
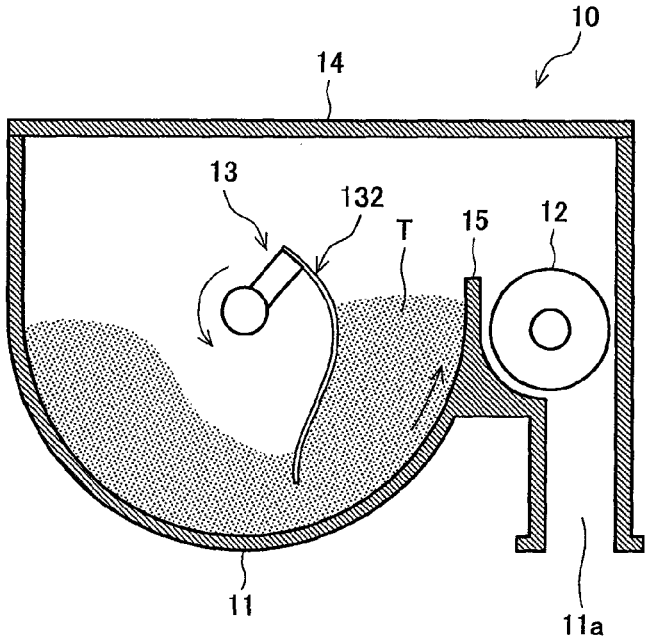
FIGS. 6A and 6B are conceptual views showing a state where toner in a toner storage container is scooped up.
Figure 6B:
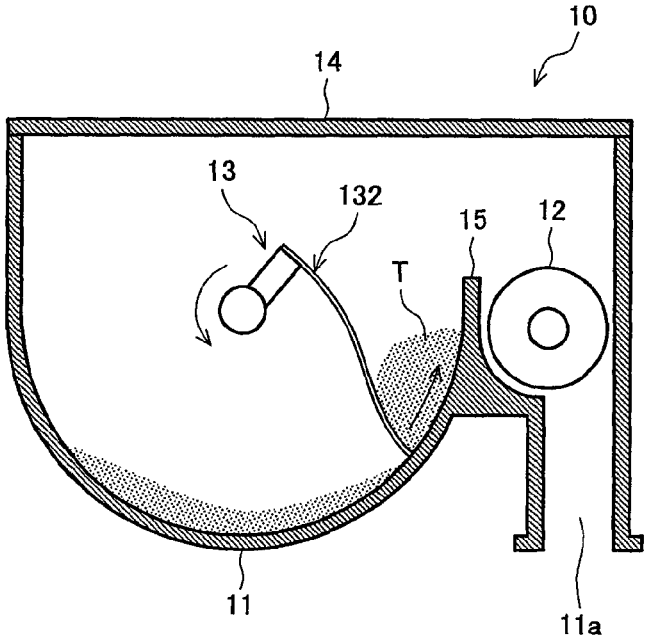

FIGS. 6A and 6B are conceptual views showing a state where toner T in the toner storage container 11 is scooped up when the toner scooping blade 132 rotates in the direction indicated by an arrow, in which FIG. 6A shows a state where a remaining amount of toner is large and FIG. 6B shows a state where a remaining amount of toner is small.

As shown in FIG. 6A, when the amount of the toner T is large in the toner storage container 11, the toner scooping blade 132 is bent largely due to pressure given from the toner T, so that the stress imposed on the toner T is not increased excessively.

On the other hand, as shown in FIG. 6B, when the amount of the toner T is small in the toner storage container 11, pressure given from the toner T is reduced and the toner scooping blade 132 is not bent so largely that the tip end of the toner scooping blade 132 that is bent in a substantially S-shape is able to scoop up the toner T effectively.

In this manner, when the toner scooping member 13 rotates around the blade support rotary shaft 131*a*, the toner stored in the toner stirring portion 10*a* of the toner storage container 11 is stirred and when the toner scooping blade 132 slides over the inner wall of the toner storage container 11 as it changes its shape, the toner scooping blade 132 scoops up the toner stored in the toner stirring portion 10*a* of the toner storage container 11 to transport to the toner discharge portion 10*b*. The toner in the toner discharge portion 10*b* is supplied by the toner discharge member 12 to the developing vessel 21 of the developing device 20 through the toner discharge port 11*a*.

Next, description will be given in detail for the developing device 20.

Figure 7:
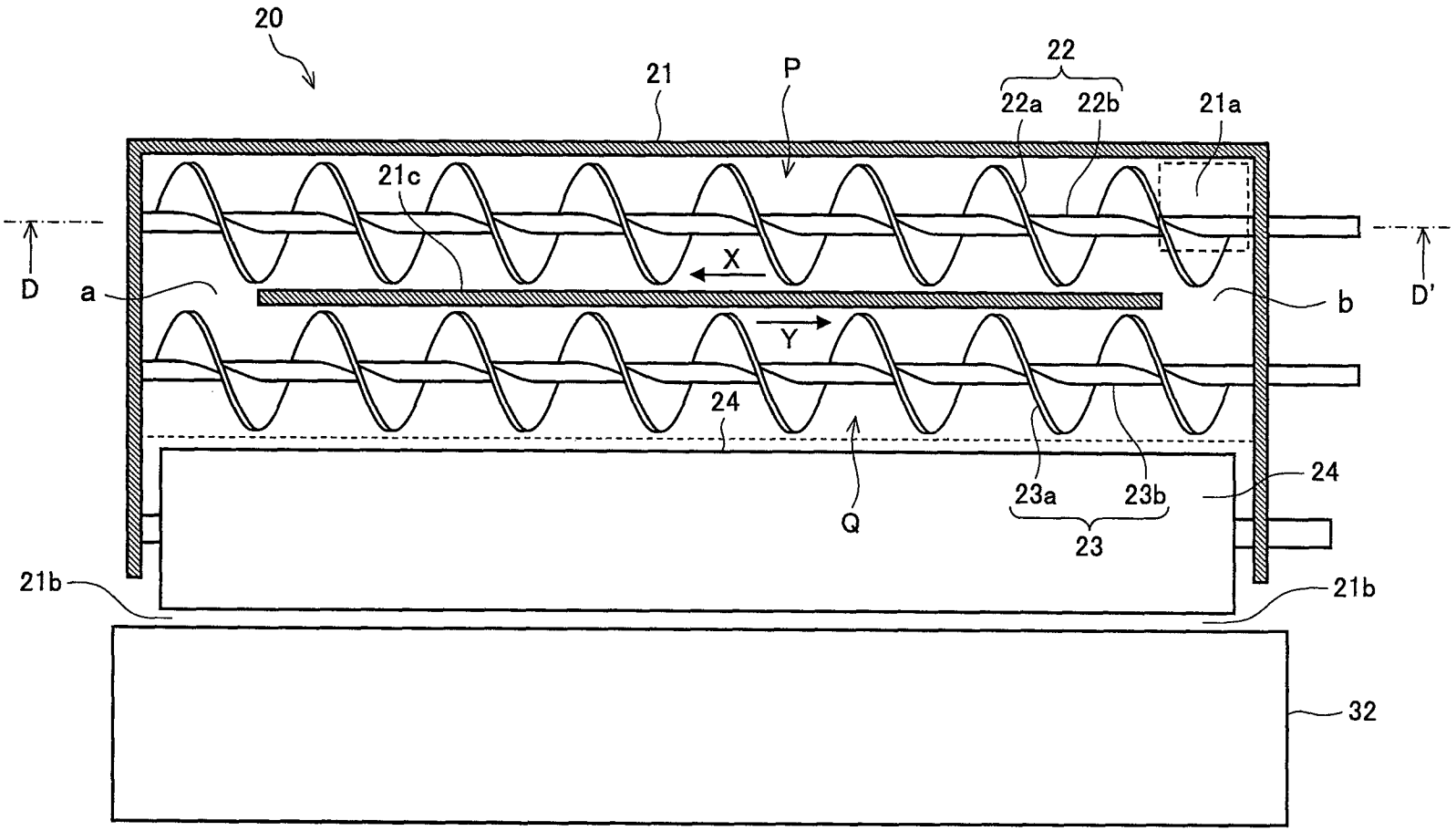
FIG. 7 is a view along a C-C' line of the developing device shown in FIG. 2.
Figure 8:
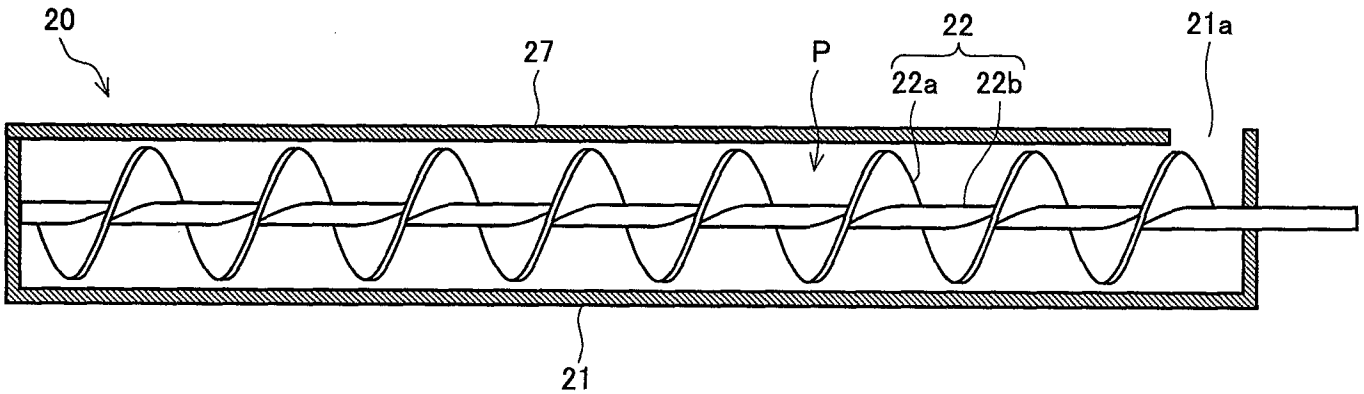
FIG. 8 is a view along a D-D' line of the developing device shown in FIG. 7.

FIG. 7 is a view along a C-C' line of the developing device 20 shown in FIG. 2 and FIG. 8 is a view along a D-D' line of the developing device 20 shown in FIG. 7.

As shown in FIGS. 2, 7 and 8, the developing device 20 has the developing vessel 21, a first transport member 22, second transport member 23, a developing roller 24, a regulating member 25 and a permeability sensor 26.

The developing vessel 21 is a container-shaped member formed to have a substantially rectangular columnar shape, having an inner space for storing a two-component developer containing toner and a magnetic carrier, and is disposed facing the photosensitive drum 32. An opening 21*b* is formed on the side of the developing vessel 21 that faces the photosensitive drum 32 and the developing roller 24 is provided at a position opposite to the photosensitive drum 32 through the opening 21*b*.

The developing vessel 21 is provided with the first transport member 22, the second transport member 23 and the developing roller 24, which are axially supported by the developing vessel 21 in a rotatable manner.

As shown in FIG. 7, the first transport member 22 is composed of a screw auger having a helical first transport vane 22*a* and a first rotary shaft 22*b*, the second transport member 23 is composed of a screw auger having a helical second transport vane 23*a* and a second rotary shaft 23*b*, and the first transport member 22 and the second transport member 23 rotate to stir and transport the two-component developer.

In addition, as shown in FIG. 2, a removable developing vessel cover 27 is provided on the developing vessel 21. Further, in the developing vessel cover 27, the toner receiving port 21*a* for communicating with the toner discharge port 11*a* of the toner supplying device 10 is provided at one end on the upper side of the first transport member 22, and toner is supplied from the toner supplying device 10 through the toner receiving port 21*a* in accordance with the state of toner consumption in the developing vessel 21.

In the developing vessel 21, a partition panel 21*c* is disposed between the first transport member 22 and the second transport member 23. The partition panel 21*c* extends in parallel with each axial direction (each axial shaft direction) of the first transport member 22 and the second transport member 23.

As shown in FIG. 7, the partition panel 21*c* divides the interior of the developing vessel 21 into a first transport passage P in which the first transport member 22 is placed and a second transport passage Q in which the second transport member 23 is placed.

The partition panel 21*c* is disposed to be separated from the inner wall surface of the developing vessel 21 at opposite ends in each axial direction of the first transport member 22 and the second transport member 23. Whereby, in the developing vessel 21, communicative connection paths that communicatively connect the first transport passage P to the second transport passage Q are formed near the opposite ends in each axial direction of the first transport member 22 and the second transport member 23. Hereinafter, as shown in FIG. 7, the communicative connection path formed on the side in the direction indicated by an arrow X will be referred to as a first communicative connection path a, and the communicative connection path formed on the side in the direction indicated by an arrow Y will be referred to as a second communicative connection path b.

The first transport member 22 and the second transport member 23 are arranged in parallel with each other so that peripheral surfaces of both members face each other across the partition panel 21*c* and shafts of both members are parallel with each other, and the transport members are set to rotate in the opposite direction. Further, as shown in FIG. 7, the first transport member 22 is set to transport the two-component developer in the direction indicated by the arrow X, while the second transport member 23 is set to transport the two-component developer in the direction indicated by the arrow Y that is opposite to the direction indicated by the arrow X.

Further, the toner receiving port 21*a* is formed in an area within the first transport passage P and on the side of the second communicative connection path b.

In the developing vessel 21, each of the first transport member 22 and the second transport member 23 is driven to rotate by a driving motor (not-shown) to transport the two-component developer.

In this manner, the two-component developer circulates the first transport passage P, the first communicative connection path a, the second transport passage Q and the second communicative connection path b in this order in the developing vessel 21. The two-component developer is scooped up being held on the surface of the developing roller 24 by the rotation of the developing roller 24 while being transported through the second transport passage Q, and toner in the two-component developer scooped up is moved to the photosensitive drum 32 and is consumed sequentially.

To replenish toner that is consumed in this manner, unused toner is supplied through the toner receiving port 21*a* into the first transport passage P as described above. The supplied toner is mixed and stirred with the two-component developer already present in the first transport passage P.

The developing roller 24 is a roller-shaped member that is axially supported to be rotationally drivable around its axis by a driving portion (not shown), and supplies the two-component developer composed of toner and a carrier to the surface of the photosensitive drum 32 to develop (visualize) an electrostatic latent image formed on the surface of the photosensitive drum 32.

The regulating member 25 shown in FIG. 2 regulates thickness of the layer of the two-component developer transported being held on the surface of the developing roller 24.

The permeability sensor 26 shown in FIG. 2 is such a type of sensor that outputs a toner concentration detection result as an output voltage value when a control voltage is applied, and is attached to the bottom surface of the developing vessel 21, so that the detection surface is exposed to the interior of the developing vessel 21. The permeability sensor 26 is connected electrically to toner concentration control means (not-shown). The toner concentration control means drives to rotate the toner discharge member 12 provided in the toner supplying device 10 in accordance with a toner concentration measurement value detected by the permeability sensor 26 and supplies toner into the developing vessel 21 through the toner discharge port 11*a*.

As described above, according to the toner supplying device of the present invention, since a deformation amount of the toner scooping blade increases when a toner amount remaining in the toner storage container is large, it is possible to lower a driving torque and suppress the stress on toner. Further, even when a toner amount remaining in the toner storage container becomes small, the tip end of the toner scooping blade is tough, therefore, it is possible to certainly scoop up toner.

According to the present invention, it is possible to achieve both reduction of the stress on toner in scooping up toner when a toner amount remaining in the toner storage container is large and improvement of toner scooping force in scooping up toner when a toner amount remaining in the toner storage container is small. As a result, it is possible to suppress toner deterioration and to supply toner stably, resulting that a stable image concentration can be obtained for long periods.

The invention claimed is:

1. A toner supplying device supplying toner to a developing device, comprising:

a toner storage container that has a cross section formed roughly in a semicircular shape;

a toner scooping blade composed of two flexible sheets that have an end in contact with an inner wall of the toner storage container, are bonded to each other with a spacer sandwiched therebetween, and have a gap formed therebetween; and a blade support member that is provided in the toner storage container and supports and rotates the toner scooping blade with the other end of the two flexible sheets fixed, wherein the spacer is a double-sided adhesive tape of 0.05 mm or more to 1 mm or less in thickness.

2. The toner supplying device as defined in claim 1, wherein the flexible sheet is a PET film of 0.1 mm or more to 0.5 mm or less in thickness.

3. An image forming apparatus supplying toner to a developing device, comprising:

a toner storage container that has a cross section formed roughly in a semicircular shape;

a toner scooping blade composed of two flexible sheets that have an end in contact with an inner wall of the toner storage container, are bonded to each other with a spacer sandwiched therebetween, and have a gap formed therebetween; and a blade support member that is provided in the toner storage container and supports and rotates the toner scooping blade with the other end of the two flexible sheets fixed, wherein the spacer is a double-sided adhesive tape of 0.05 mm or more to 1 mm or less in thickness.

4. The image forming apparatus as defined in claim 3, wherein the flexible sheet is a PET film of 0.1 mm or more to 0.5 mm or less in thickness.

* * * * *